United States Patent [19]

Lichy

[11] Patent Number: 4,573,512

[45] Date of Patent: Mar. 4, 1986

[54] LOCKS FOR ARTICULATED ROLLING GRILLES

[76] Inventor: Dale Lichy, 4651 Sylvan Dr., Allison Park, Pa. 15101

[21] Appl. No.: 635,286

[22] Filed: Jul. 27, 1984

[51] Int. Cl.[4] ..... E05C 3/02; E06B 9/08

[52] U.S. Cl. ..... 160/133; 160/68; 292/197; 292/231

[58] Field of Search ..... 160/133, 141, 188, 84 R, 160/68; 292/197, 231

[56] References Cited

U.S. PATENT DOCUMENTS

| | | | |
|---|---|---|---|
| 1,470,250 | 10/1923 | Witten | 70/154 |
| 1,539,072 | 5/1925 | Carbis | 292/197 |
| 1,792,173 | 2/1931 | Langley | 292/197 |
| 2,747,661 | 5/1956 | Lucas | 160/10 |
| 3,068,937 | 12/1962 | Christensen | 160/41 |
| 3,850,465 | 11/1974 | Hill et al. | 292/231 |
| 3,853,166 | 12/1974 | Wrono | 160/133 |
| 4,365,660 | 12/1982 | Henkenjohann | 160/133 |
| 4,493,356 | 1/1985 | Hermann | 160/133 |

FOREIGN PATENT DOCUMENTS

| | | | |
|---|---|---|---|
| 2411296 | 8/1979 | France | 160/133 |

*Primary Examiner*—Reinaldo P. Machado

*Attorney, Agent, or Firm*—Buell, Ziesenheim, Beck & Alstadt

[57] ABSTRACT

An automatic lock for a rolling grille or the like is enclosed in guide means on each side of the opening to be closed and is actuated by an effort to open the grille by applying external forces opposite the direction of closure but released by lift tension.

12 Claims, 13 Drawing Figures

LOCKS FOR ARTICULATED ROLLING GRILLES

This invention relates to locks for articulated rolling grilles and particularly to a self energizing lock for such grilles.

The use of rolling grilles to protect business establishments is old and well known and many forms of locks have been proposed for fastening them against access by intruders. Such rolling grilles are generally power operated by means of a power driven shaft at the top around which the grille is wrapped as it is raised. Historically, such grilles have been fastened by locks to members fixed in the floor or pavement at the bottom of the openings being closed and protected or by cylinder locks which operated in a bottom bar of the grille into the sidewall of the opening frame. A problem with both of these arrangements is that if the lift motor is energized without unlocking all of the locks, the grille is badly damaged or the drive is damaged, or both. Some grille arrangements have depended solely on the weight and structure of the grille to close the opening, without any locks. Experience has shown that there is always sufficient "play" or slack that an intruder, particularly with assistance, can raise the bottom bar of such grilles and sufficient distance so that the intruder can roll or crawl under the grille. Self-acting locks of various forms have heretofore been proposed for such grilles. Among them are those disclosed in my copending application, Ser. No. 588,246, filed Mar. 12, 1984 as well as those disclosed in U.S. Pat. No. 3,850,465.

One of the problems with self-acting locks of the type disclosed in U.S. Pat. No. 3,850,465 is that it requires a special end link which pivots in the middle out of alignment with the outer end links and thus tends to noticeably throw the grille out of alignment with a much shorter distance between the two grille rods between which the pivoting link occurs. The pivoting link is made up of a locking link and a pivot link which is half the length of a standard link. The pivot link is fastened to one grille rod at one end and the lock link is fastened at one end to the next adjacent grille rod. The other end of the pivot link is pivotally fastened intermediate the ends of the lock link so that when slack occurs in the grille the two links pivot out of alignment and the free end of the locking link engages the side of the guide channel for the grille in locking engagement so that any attempt to lift the grille results in locking of the lock link in the guide. This in turn significantly and noticeably shortens the distance between the two grille rods and because of the toggle action it causes the locking link and pivot link to be out of alignment with the remainder of the grille links. This also requires that the guide channel on each side be wider than the lift links by a substantial amount in order to permit the toggle action to occur. All of these factors are undesirable.

I have invented a lock for articulated rolling grilles which eliminates all of the problems of prior art devices and yet is simple and inexpensive to install on any conventional rolling grille with side links.

I provide an articulated rolling closure for an opening in a building fixed at one end of said opening for movement toward and from the opposite end in combination with a guide slot structure for installation on opposite sides of the building opening transverse to said one end, at least one lock abutment on said guide slot, at least two generally parallel spaced rods extending across the opening to said opposite guides slots, at least one lift link connecting said at least two parallel rods at each end within the guide slots, an elongate hole receiving the parallel rod more remote from said one end of the opening in one of said at least one lift link connecting said at least two parallel rods and a second lift link at each end of the parallel rod remote from said one end of the opening, a guide member intermediate the ends of said at least one lift link and parallel to said at least two parallel rods, a locking link means parallel to said at least one lift link and pivotally mounted to the parallel rod more remote from said shaft whereby when the rod more remote from said shaft is moved toward the shaft relative to one of the at least two parallel rods less remote from the shaft, the locking link means is urged upwardly and outwardly by the guide member into locking engagement with the lock abutment means. A keeper means is peferably connected to one of the rod and guide members for holding said locking link in position on the guide member.

In the foregoing general description I have set out certain objects, advantages and purposes of this invention.

Other objects, purposes and advantages of this invention will be apparent from a consideration of the following description and the accompanying drawings in which.

Figure 1:
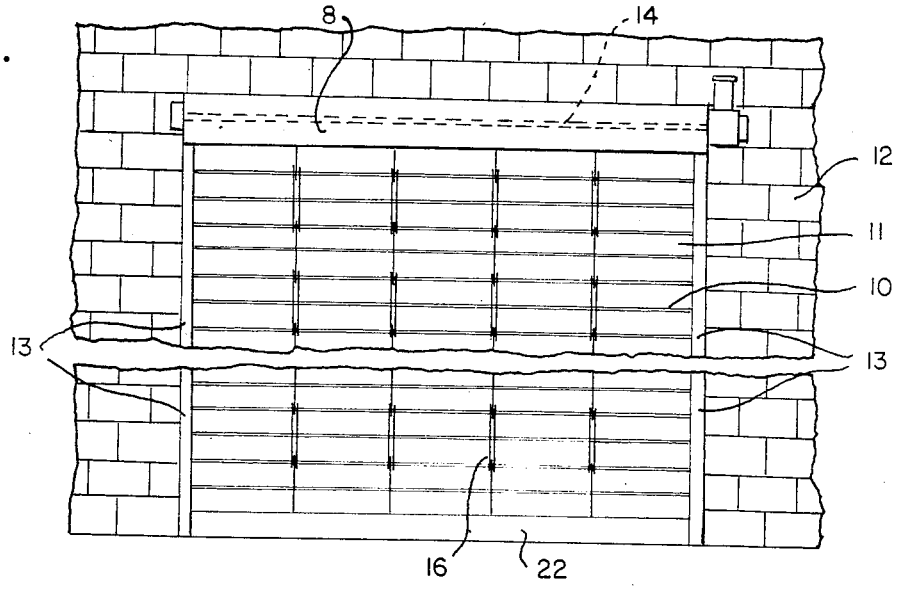
FIG. 1 is an elevational view of the interior of an articulated rolling grille embodying the invention.
Figure 4:
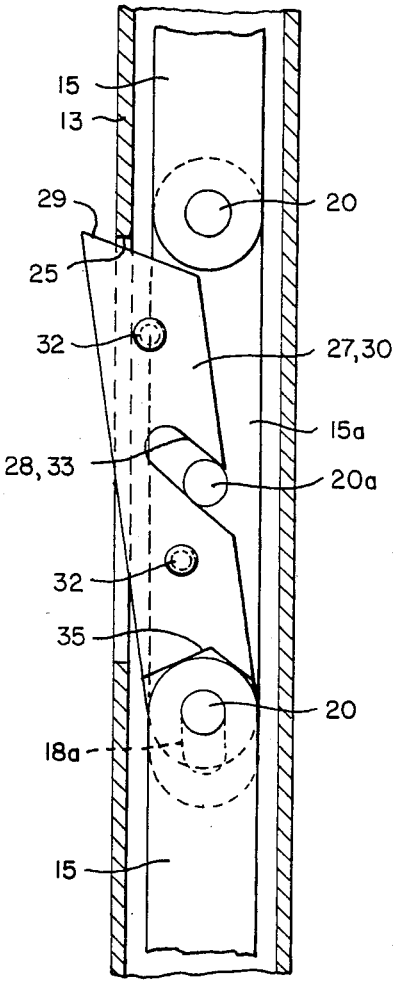
FIG. 4 is a side elevational view of the structure of FIG. 3 with the lock in a locked condition.
Figure 3:
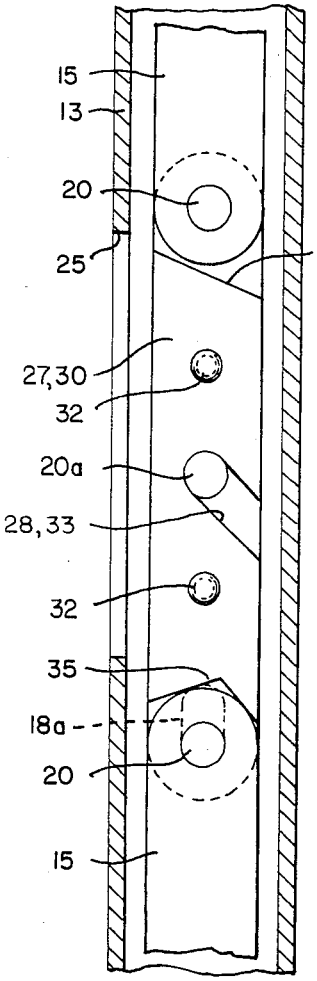
FIG. 3 is a side elevational view of the structure of FIG. 2.
Figure 2:
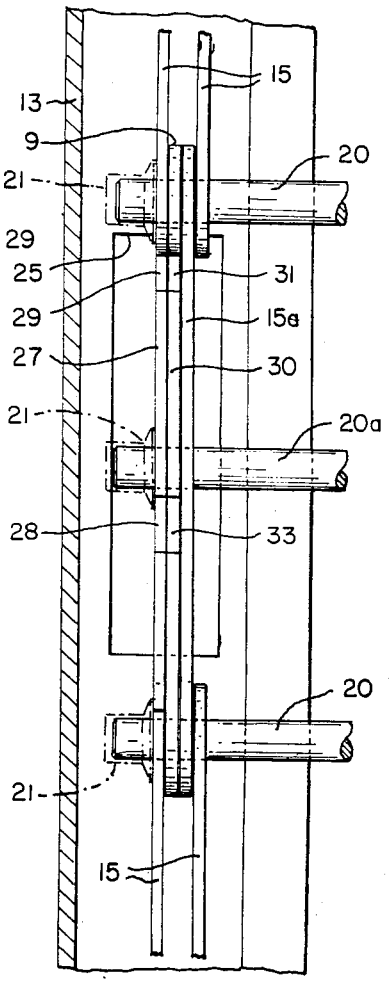
FIG. 2 is an end elevational view of the locking structure of the present invention in the normal condition.
Figure 5:
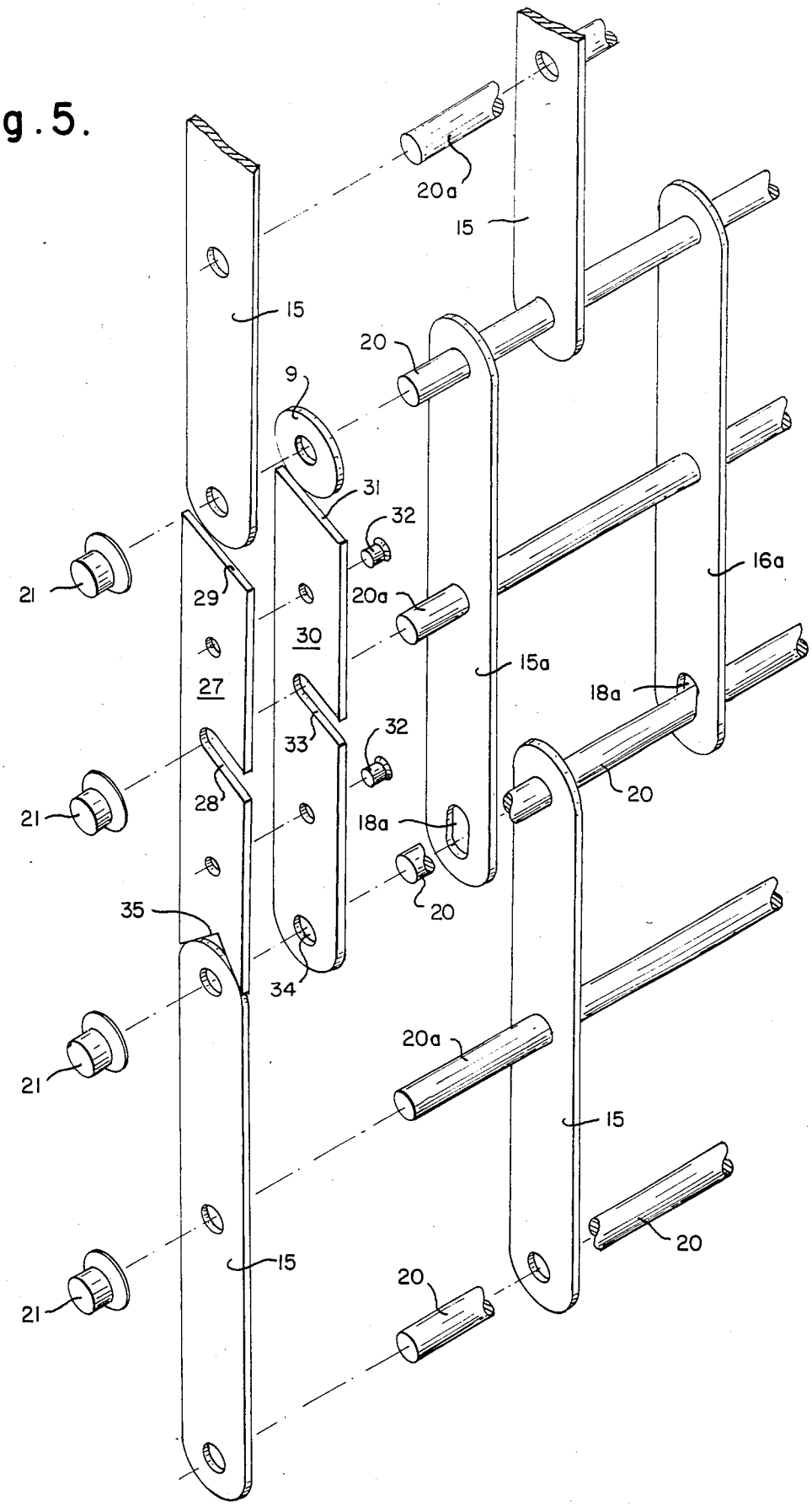
FIG. 5 is an exploded view of the structure of FIG. 2.

Referring to the drawings I have illustrated a preferred embodiment of this invention in FIGS. 1–5 in which an articulated rolling grille 10 is shown in the closed condition barring an opening 11 in a building 12. The rolling grille 10 is conventional in having an overhead coil box 8 into which the grille is rolled and unrolled through a motor driven shaft 14 along a generally vertical path in vertical side guides 13 along each side of opening 11. In general, the grille may follow any of the well known forms but preferably it is made up of a plurality of lift links 15 (FIG. 5) along each side with intermediate links 16 (FIG. 1) between the side links across the opening. Each link, both side and intermediate, is provided with three holes, one at each end and one intermediate the ends. One set of lift links **15*a* and intermediate links 16*a* has a bottom elongate hole 18*a***.

All of the holes extend axial transverse to the length of the links and receive the top and bottom transverse grille rods 20 and intermediate grille rods 20*a*. The grille rods 20 and 20*a* extend across the width of the opening and the ends extend through the holes in the lift links on each side and are held by keepers or end caps 21 on the rod ends. A bottom bar 22 (FIG. 1) is arranged at the lower or free end of the grille. The lift links 15 and a portion of each side of grille 10 runs within the side guides 13 so that grille 10 can be moved vertically between the open and closed position by the motor and shaft. All of the foregoing structure is conventional and well known.

In my locking structure I provide one or more lock abutments 25 formed on one wall of guide 13. The abutments may take the form of a slot in the sidewall as shown or they may be openings though the sidewall with an access cover (not shown) or any of a variety of discontinuities against which the lock link hereafter described can engage.

A lock link 27 having an angular slot 28 intermediate its ends extending angularly upwardly from one sidewall is movably mounted on intermediate grille rod 20*a* by slot 28. The top end of locking link 27 is provided with an angular face 29 extending generally parallel to the angle of slot 28. A keeper link 30 having a top angular face 31 corresponding to that of link 27 is fixed to link 27 by rivets 32 intermediate its length and is provided with an angular slot 33 corresponding to slot 28 of link 27. Lock link 27 and keeper link 30 are utilized as a locking link means. The opposite end of keeper link 30 is provided with a circular hole 34 sized to receive rod 20. The locking link means, therefore, is pivotally mounted to guide member or rod 20. The lock link 27 has a generally V-shaped groove 35 which, when the grille is lowered and the elongate holes 18*a* are resting on the next lower grille rod, engages the top of the next lower lift link causing the lock link 27 and keeper link 30 to be forced laterally outward to engage the lock abutments 25. The outward movement is caused by angular slots 28 and 33 on the lock link and keeper link. When the grille is raised and the lift links are under tension, the lock link and keeper link are pulled back into alignment with the lift links and the door is unlocked and free to move vertically. A spacer 9 (FIGS. 2 and 5) is provided between the links 15 and 15*a* on shaft 20 to provide clearance for locking link 27 and keeper link 30.

The principle of operation is generally explained above, however, in summary it is as follows. When the grille is lowered to close opening 11, the bottom bar 22 reaches the floor, whereupon the special lift links 15*a* and special intermediate links 16*a* continue to lower on elongated holes 18*a* until the top of elongate opening 18*a* reaches grille rod 20. When the grille is lifted from any point below the lock link or further lowered from a point above the lock link, the top of the next lower lift link 15 engages V notch 35 forcing lock link 27 upwardly and outwardly as slot 28 moves on guide rod member 20*a*. This also carries keeper link 30 and both angular ends 29 and 31 engage locking abutment 25 in the guide slot to lock the grille against being lifted from the bottom. When the lift motor is energized and the lift links are raised from a point above the lock link, the opposite motion occurs and the lock and carrier links move into alignment with the lift links freeing the grille automatically. It will be obvious to those skilled in the art that lock link 27 and keeper link 30 may be provided as a single one piece milled lock link means rather than as two separate pieces as shown.

Figure 8:
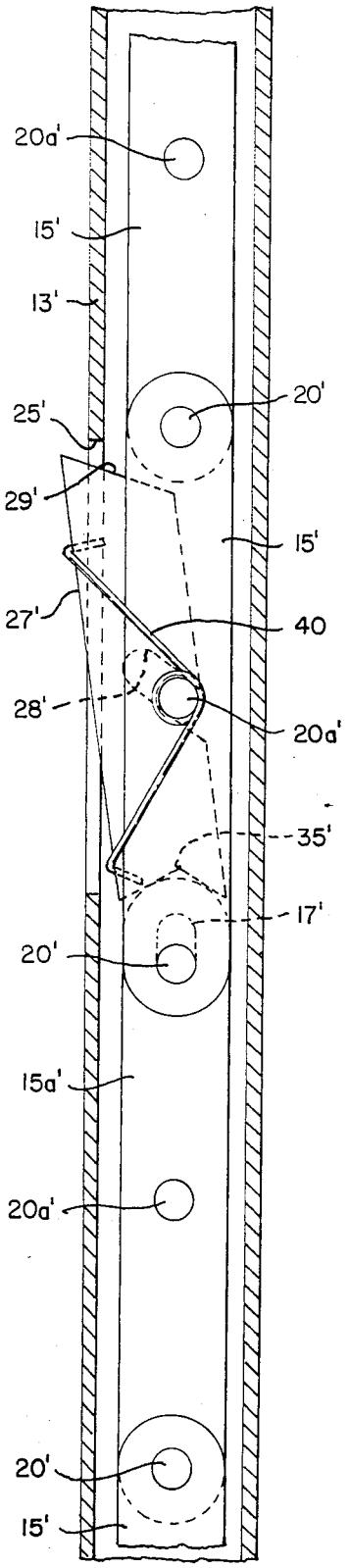
FIG. 8 is a side elevational view of the structure of FIG. 7 with the lock in a locked condition.
Figure 7:
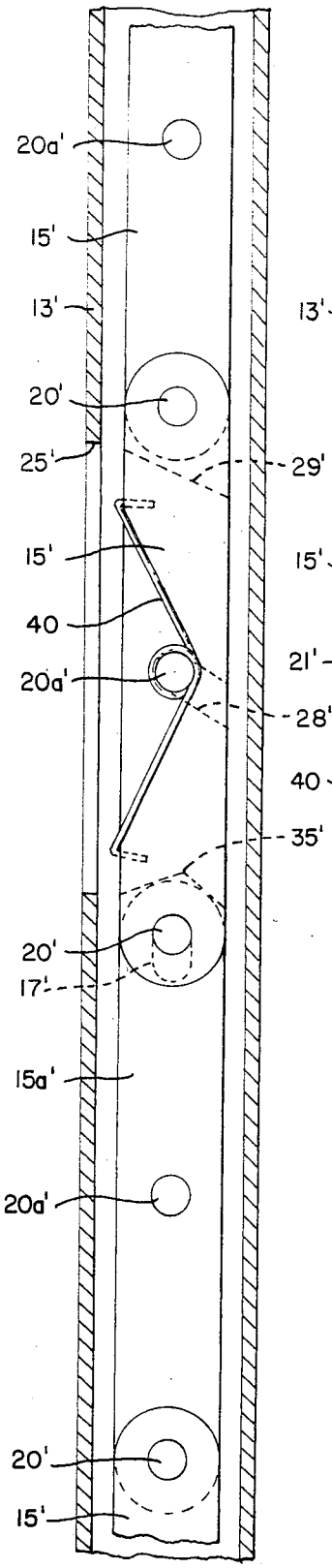
FIG. 7 is a side elevational view of the structure of FIG. 6.
Figure 6:
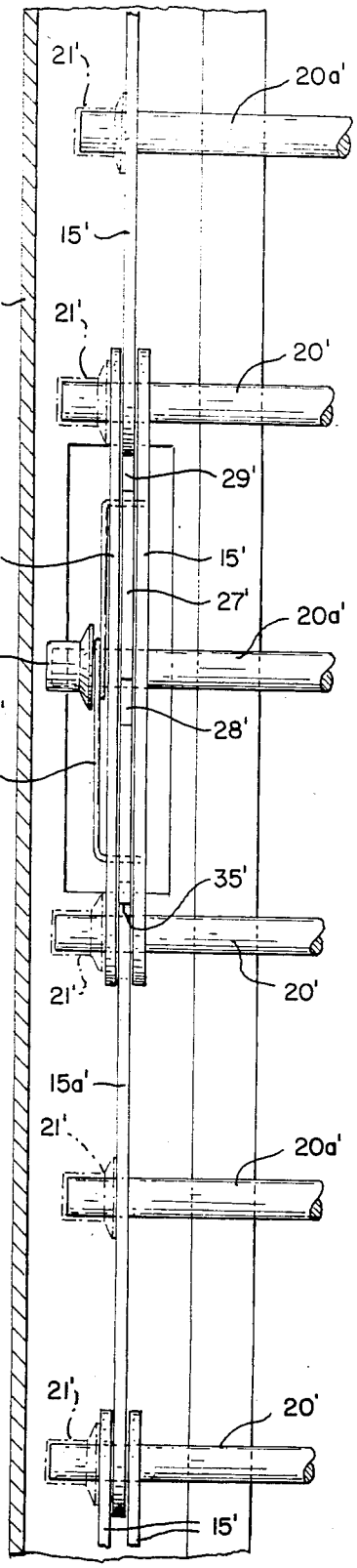
FIG. 6 is an end elevational view showing a second embodiment of the present invention in the normal condition.
Figure 9:
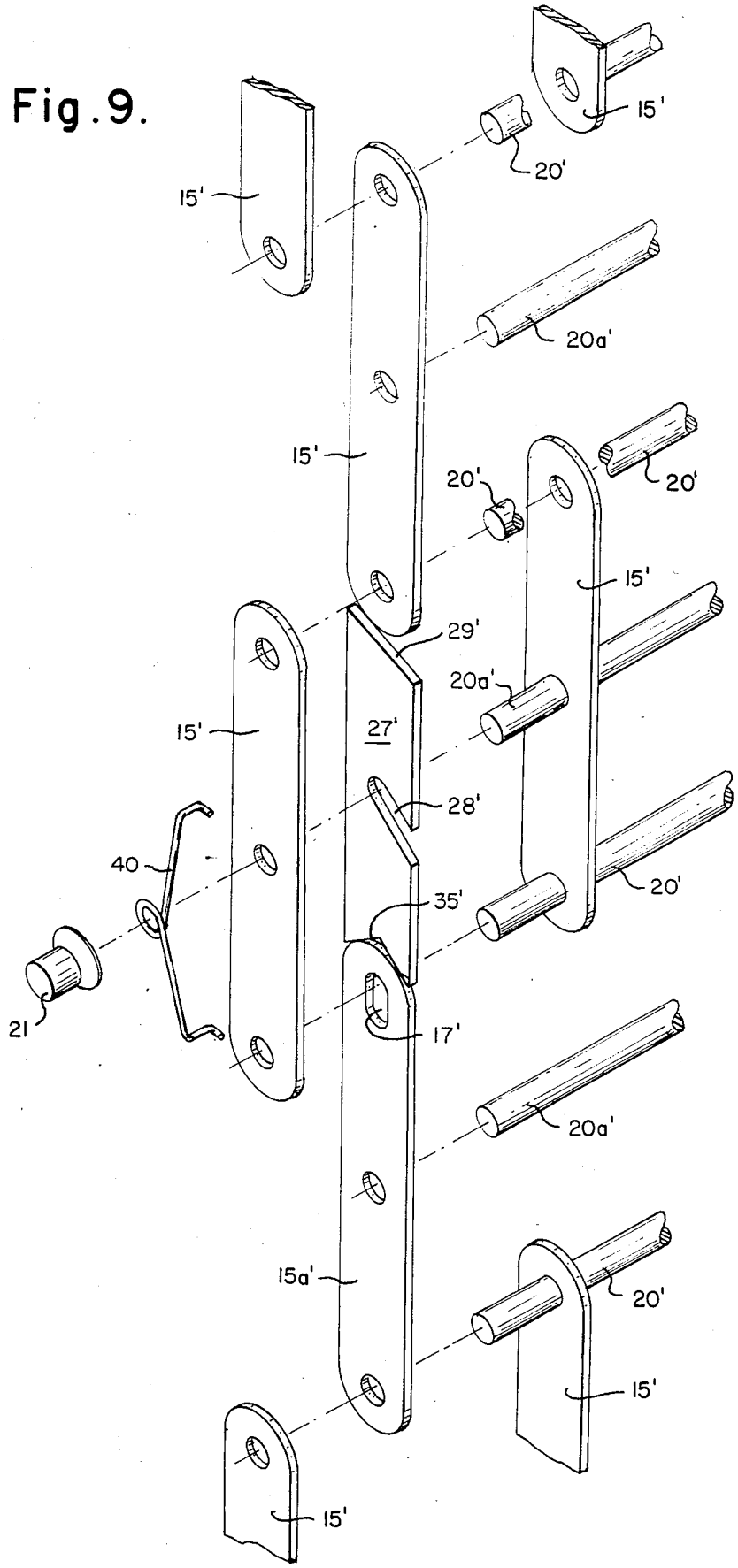
FIG. 9 is an exploded view of the structure of FIG. 6.

In FIGS. 6–9, I have illustrated a second embodiment of my invention in which like parts are given numbers with a prime sign. In this embodiment in which the lift links 15' are arranged in series of two, one, and two from top and bottom, I place lock link 27' over intermediate guide rod 20*a'*. A keeper spring 40 mounted on rod 20*a'* is bent over both ends of lock link 27' and the two lift links 15' to hold the lock link in position. The next single link 15*a'* below the pair carrying the lock link has an elongate top hole 17' In operation when the grille is lowered and the bottom bar reaches the floor surface, continued lowering of the door forces rod 20' beneath the lock link 27' downwardly in slot 17' which causes link 15*a'* to move upwardly into notch 35' in lock link 27'. This in turn causes lock link 27' to move upwardly and the top outwardly as the link is guided on slot 28' and rod 20*a'* against spring 40. The same result occurs if the grille is lifted from a point below the lock link. When the door is raised from a point above the lock link the opposite action occurs.

Figure 12:
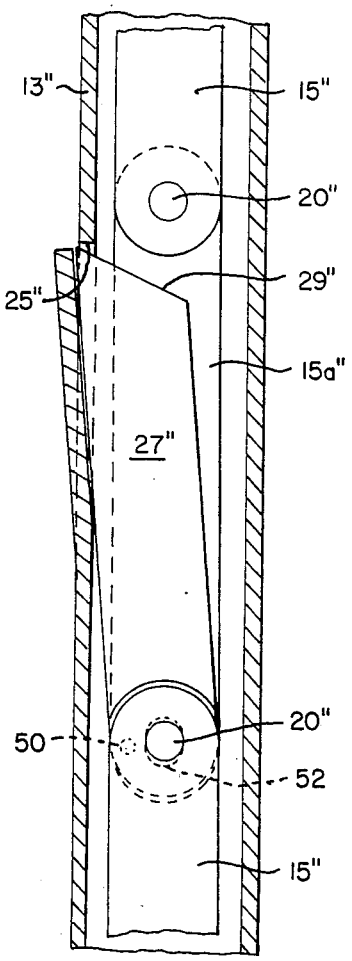
FIG. 12 is a side elevational view of the structure of FIG. 11 with the lock in a locked condition.
Figure 11:
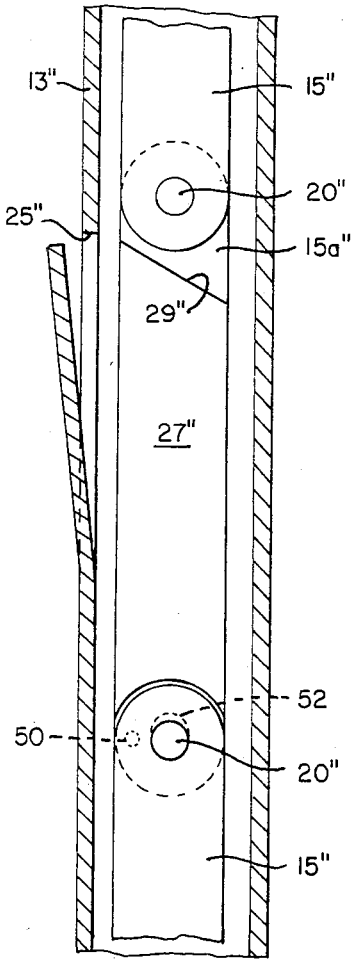
FIG. 11 is a side elevational view of the structure of FIG. 10.
Figure 10:
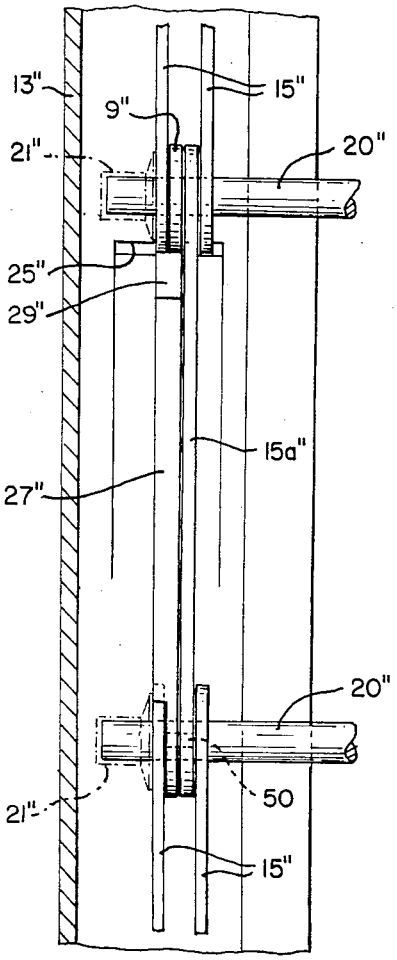
FIG. 10 is an end elevational view showing a third embodiment of the present invention in the normal condition.
Figure 13:
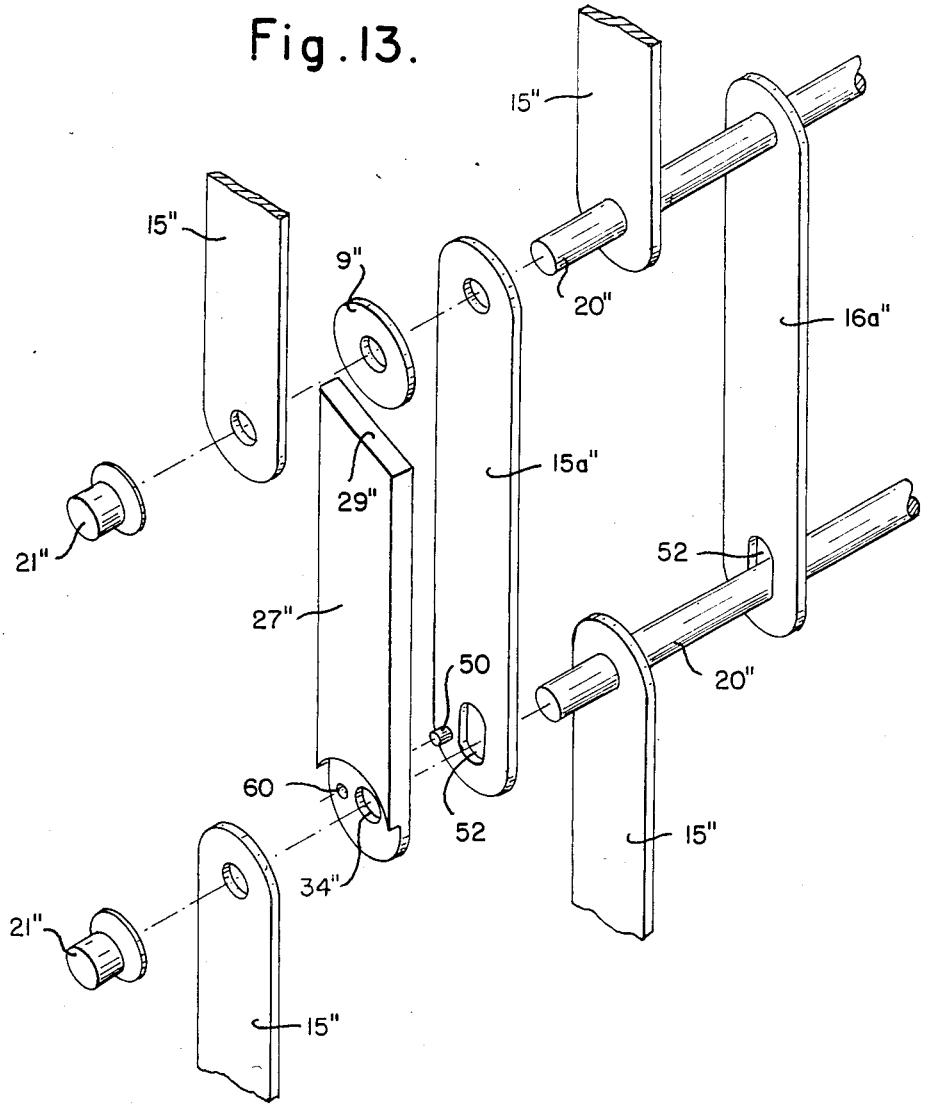
FIG. 13 is an exploded view of the structure of FIG. 10.

In the third embodiment of FIGS. 10–13, I have illustrated an embodiment adapted to situations where only single successive lift links are used. Each link has two rather than three holes with one provided in each end thereof. In this embodiment like parts are given like numbers with a double prime. In this embodiment, lock link 27'' is pivotally mounted on a pin 50 attached a special lift link 15*a''*. When rod 20'' is lifted within elongated holes 52 of special lift link 15*a''* and intermediate link 16*a''*, lock link 27'' is caused to rotate about guide member or pin 50 by rod 20 in hole 34'' urging angular face 29'' into engagement with lock abutment 25''. Pin 50 is received by a small hole 60 provided in lock link 27'' adjacent to the lower hole provided therein for rod 20.

In the foregoing specification I have set out certain preferred practices and embodiments of this invention, however, it will be understood that this invention may be otherwise embodied within the scope of the following claims.

I claim:

1. An automatic lock structure for articulated rolling grilles and like structures to be rolled up at one end for unbarring an opening comprising an articulated rolling closure for said opening, a shaft at one end of said opening connected to one end of said rolling closure for rolling the same around said shaft for opening the closure, a guide slot structure on opposite sides of said opening transverse to said shaft, said guide slot structure receiving and concealing opposite side edges of said rolling closure, at least one lock abutment means on at least one guide slot structure, at least two generally parallel spaced rods extending across the opening between said opposite guide slots, at least one first lift link connecting said at least two parallel rods at each end within the guide slots, a second lift link at each end of a parallel rod an elongate hole in one end of one of said lift links receiving the parallel rod more remote from said shaft, a guide member intermediate the ends of said at least one first lift link and parallel to said at least two parallel rods, a locking link means parallel to said at least one lift link and movable relative to the parallel rod more remote from said shaft whereby when the rod more remote from said shaft and a rod less remote from the shaft are moved relatively closer together the locking link means is urged outwardly by the guide member into locking engagement with the lock abutment means.

2. An automatic lock structure according to claim 1 wherein said guide member is a rod intermediate said at least two parallel rods and said locking link means further comprises a locking link having an inclined slot intermediate the ends thereof and engaged on said guide member rod, said locking link further having a generally inclined face on one end thereof and a generally V notch on the other end thereof opening away from the shaft and bearing on an end of said second lift link, keeper means connected to at least one of the remote rod and the guide member rod for holding the locking link in position on the guide member whereby when the at least two rods are moved relatively closer together the second lift link engages the V end of the locking link urging it outwardly on the guide member rod into locking engagement with the lock abutment means.

3. An automatic lock structure according to claim 1 wherein said guide member is a pin affixed to said first lift link at a location adjacent to where said first lift link is connected to said more remote rod, said first lift link having the elongated hole therein through which said remote rod extends, said locking link means having a first hole in one end thereof sized to receive said more remote rod and having a second hole therein adjacent to said first hole sized to receive said guide member pin, further comprising a keeper means for holding said locking link in position on said guide member pin whereby moving the at least two rods relatively closer together causes the locking link to move and rotate outwardly about the guide member pin into locking engagement with the lock abutment means.

4. A lock structure as claimed in claim 2 wherein the keeper means is a link having an inclined slot intermediate its ends and an inclined face at one end substantially indentical to that of the locking link, fastener means attaching said locking means to said keeper means and a slotted opening at the other end of said keeper means fitting on the rod remote from the shaft.

5. A lock structure as claimed in claim 2 wherein the keeper means is a spring fixed on the guide member and overlapping both the lift link and locking link.

6. A lock structure as claimed in claim 2 wherein the keeper means is a clip on the guide member and overlapping the slot in the locking link.

7. A lock structure as claimed in claim 1 wherein the locking link means is enclosed within the guide means at at least one side of the opening.

8. A lock structure as claimed in claim 2 wherein the locking link means is enclosed within the guide means at at least one side of the opening.

9. A lock structure as claimed in claim 3 wherein the locking link means is enclosed within the guide means at at least one side of the opening.

10. A lock structure as claimed in claim 4 wherein the locking link means is enclosed within the guide means at at least one side of the opening.

11. A lock structure as claimed in claim 5 wherein the locking link means is enclosed within the guide means at at least one side of the opening.

12. A lock structure as claimed in claim 6 wherein the locking link means is enclosed within the guide means at at least one side of the opening.

* * * * *

UNITED STATES PATENT AND TRADEMARK OFFICE

CERTIFICATE OF CORRECTION

PATENT NO. : 4,573,512

DATED : March 4, 1986

INVENTOR(S) : DALE LICHY

It is certified that error appears in the above-identified patent and that said Letters Patent is hereby corrected as shown below:

Column 4, line 12, after 17', insert --.--.

Signed and Sealed this

*Seventeenth* Day of *June 1986*

[SEAL]

*Attest:*

DONALD J. QUIGG

*Attesting Officer*

*Commissioner of Patents and Trademarks*